United States Patent [19]

Taylor, Jr.

[11] 4,384,806

[45] May 24, 1983

[54] CONCRETE EXTRUSION APPARATUS

[76] Inventor: Edgar J. Taylor, Jr., P.O. Box 1441, Anderson, Calif. 96007

[21] Appl. No.: 237,556

[22] Filed: Feb. 24, 1981

[51] Int. Cl.[3] ..... E01C 11/28

[52] U.S. Cl. ..... 404/98; 404/105; 404/108; 404/115

[58] Field of Search ..... 404/98, 105, 108, 110; 425/63, 449

[56] References Cited

U.S. PATENT DOCUMENTS

| | | | |
|---|---|---|---|
| 2,101,031 | 12/1937 | Little | 404/102 |
| 2,225,015 | 12/1940 | Lebelle | 404/75 |
| 2,664,794 | 1/1954 | Evans | 404/105 |
| 2,779,258 | 1/1957 | Johnson | 404/105 |
| 3,161,117 | 12/1964 | Surject | 404/98 |
| 3,175,477 | 3/1965 | Cheney | 404/98 |
| 3,188,928 | 6/1965 | Guntert | 404/108 |
| 3,354,801 | 11/1967 | Hanson | 404/108 X |
| 3,362,308 | 1/1968 | Austin | 404/116 X |
| 3,363,523 | 1/1968 | Brock et al. | 404/98 |
| 3,363,524 | 1/1968 | Catenacci | 404/105 X |
| 3,472,134 | 3/1968 | Wilbur | 404/113 |
| 3,685,405 | 8/1972 | McDonald et al. | 404/105 |
| 3,733,140 | 5/1973 | James | 404/98 |
| 3,792,133 | 2/1974 | Goughnour | 404/98 |
| 3,890,055 | 6/1975 | Rochfort | 404/84 |
| 4,145,155 | 3/1979 | Ogaki | 404/98 |
| 4,217,065 | 8/1980 | Stilwell | 404/98 |

*Primary Examiner*—Nile C. Byers, Jr.
*Assistant Examiner*—Beverly E. Hjorth
*Attorney, Agent, or Firm*—Townsend and Townsend

[57] ABSTRACT

Apparatus for extruding a continuous concrete structure along a surface such as a curb and gutter. The apparatus includes an open bottom hopper for containing a supply of concrete mounted to a vehicle. An open bottom mold extends rearwardly from the open bottom of the hopper and causes the concrete flowing from the hopper onto the surface to be provided the proper cross-sectional shape as the vehicle moves along the surface. The lower leading face of the hopper is slanted rearwardly. Vibrators are immersed within the concrete overlying the open bottom of the hopper and in an area generally horizontal with and to the rear of the lower leading face of the hopper. The combination of the slanted lower leading face and the properly situated vibrator causes the apparatus to creep or walk forward so that very little if any motive power need be applied to the vehicle. The upper surface of the mold has a slight negative pitch along most of its length, that is, it slants upwardly from front to rear, to reduce the drag on the apparatus.

8 Claims, 3 Drawing Figures

CONCRETE EXTRUSION APPARATUS

FIELD OF THE INVENTION

This invention relates to concrete extrusion machines, particularly one adapted for laying continuous lengths of curb or other concrete structures along the ground.

BACKGROUND OF THE INVENTION

Curbing forming machines in which concrete is fed from a hopper through open-bottom molds or slip forms are well known. Concrete is very often agitated to enhance its flow from the hopper through the slip form and to remove air which may be trapped within the concrete mixture.

Many of the prior art machines truly extrude the concrete by the use of large screws, pistons or plungers to force the concrete through the mold so that it assumes the desired shape. See, for example, U.S. Pat. Nos. 3,363,524 and 4,145,155. Most of the prior art machines have molds which taper down and to the rear for a significant distance. Therefore, the machine actively shapes the concrete within the mold long after it has left the hopper. These machines must therefore rely on brute force to cause the concrete to assume the desired shape while passing through the mold. Since the molds are usually open bottomed, to permit the concrete to quickly make intimate contact with the ground, physically forcing the concrete through the molds generally requires that the machine be quite large and heavy to keep the machine from riding up onto the formed concrete. Therefore, these factors often cause such machines to weigh in excess of 30,000 pounds and be quite expensive.

Certain machines have been developed to lay concrete without the use of plungers or screws. Some of these machines are generally directed to apparatus for laying flat slabs of concrete such as sidewalks or roadways. See, for example, U.S. Pat. Nos. 3,452,406 and 3,098,415. Other apparatus may use vibrators in conjunction with slip forms for forming concrete walls. Such apparatus are illustrated in U.S. Pat. Nos. 3,792,133 and 3,685,405. Curb forming machines using vibrators are shown in U.S. Pat. Nos. 2,101,031; 2,225,015; 3,472,134 and 3,890,055.

With these above mentioned prior art machines the motive power for moving the apparatus is typically externally supplied by a separate motive source. However, U.S. Pat. No. 3,363,523 discloses pavement forming apparatus in which the entire structure is vibrated causing the open bottomed mold to compact paving material, particularly bituminous paving material, and also causing the apparatus to "walk" in the direction of rotation of the eccentrics to advance the apparatus. This apparatus, however, is of the type which does not use a hopper filled with a material but rather runs over a supply of the material placed on the ground before it to form the material into the proper configuration.

Thus, what has been missing in the prior art is a relatively lightweight, inexpensive machine which can extrude concrete from a hopper into the desired shape while being propelled by the vibrational energy of immersed vibrators.

SUMMARY OF THE INVENTION

Apparatus is disclosed for extruding a continuous concrete structure, such as a curb and gutter, onto a surface. The apparatus includes an open bottom hopper for containing a supply of concrete mounted to a vehicle. An open bottom mold extends rearwardly from the open bottom of the hopper and causes the concrete flowing from the hopper onto the surface to be provided the proper cross-sectional shape soon after it leaves the hopper as the vehicle moves along the surface. The lower leading face of the hopper is slanted rearwardly. Vibrators are immersed within the concrete in an area generally horizontal with and to the rear of (i.e. directly behind) the lower leading face of the hopper. The combination of the slanted lower leading face and the properly situated and vibrated vibrators causes the machine to "walk" forward so that very little if any motive power need be applied to the vehicle. The upper surface of the mold has a slight negative pitch along most of its length to reduce drag. That is, the distance from the surface or ground to the top of the mold at the open, rear end of the mold is greater than the like distance at a point medially along the mold.

A primary advantage of the present invention results from the location of the immersed vibrators above the open bottom of the hopper, the off-horizontal orientation of the immersed vibrators and the provision of the slanted lower leading face of the hopper. As the vibrator vibrates, it moves concrete in the vicinity of the slanted face thus tending to cause the apparatus to move forward. Since the concrete, not the machine, is vibrated, the concrete is compacted, thus becoming more dense, without disruption by a vibrating mold.

The provision of the slanted lower leading face also means that the length of concrete touching the ground and bounded by the mold is reduced so that a smaller turning radius can be achieved.

The vibrators, in addition to providing propulsion, also aid in the compaction of the concrete to eliminate voids as well as to promote flow of the concrete from the hopper into the mold.

The mold has a relatively short distance during which it narrows in cross-section from its junction with the bottom of the hopper. At this point of minimum cross-section, the height of the mold above the ground increases slightly over the length of the mold. In approximately three feet of mold length the height of the mold above the ground typically increases approximately one-fourth to one-half inch. This is significant in that it ensures that the apparatus will not ride up on the concrete within the mold so that the weight required of the machine is greatly reduced. Further, the drag on the machine is reduced so that the propelling force can be reduced. Since the shaping of the concrete is completed soon after the concrete exits the hopper and while in the vicinity of the vibrators while still in a relatively plastic state, the force needed to do such shaping is reduced. These factors all contribute to a lighter, less expensive machine.

Other features and advantages of the present invention will be apparent from the following description in which the preferred embodiment has been set forth in detail in conjunction with the accompanying drawing.

DETAILED DESCRIPTION OF THE PREFERRED EMBODIMENT

Figure 1:
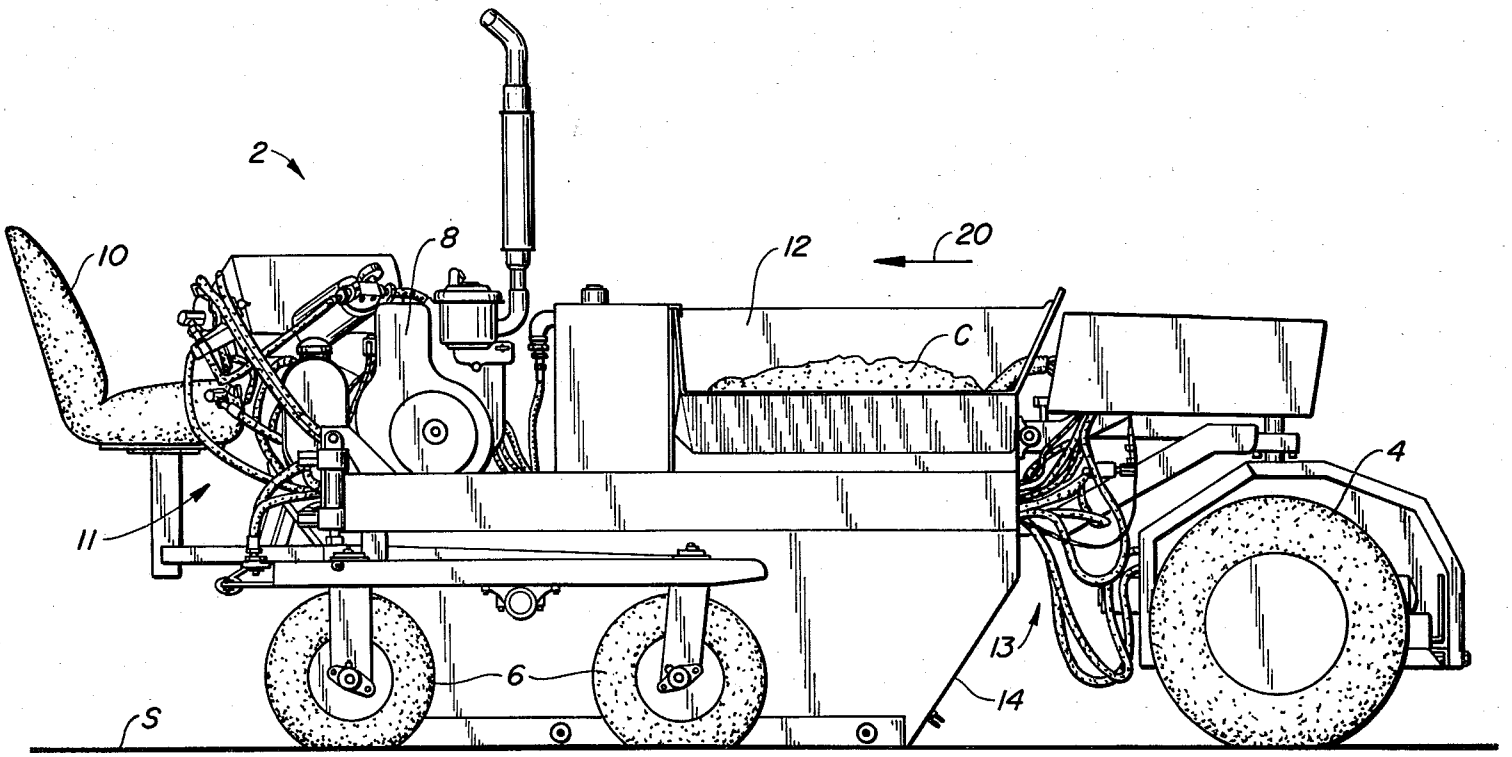
FIG. 1 is a side view of the apparatus of the present invention.
Figure 2:
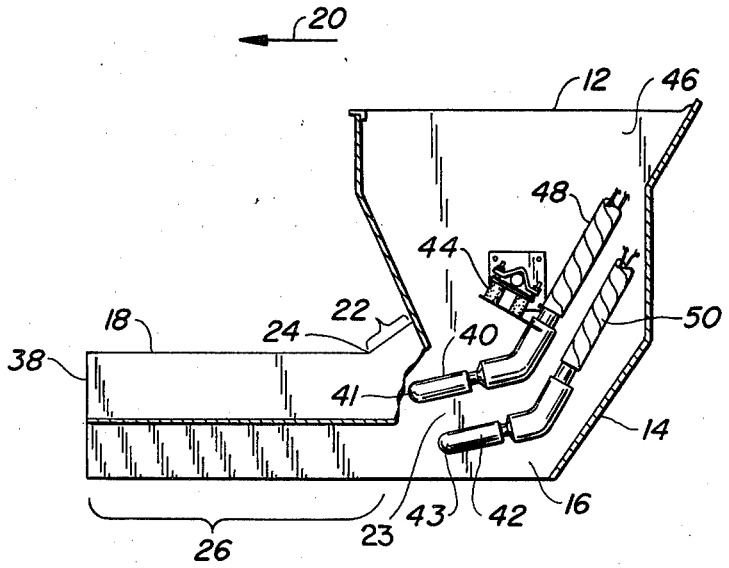
FIG. 2 is a partial cross-sectional view showing the hopper, the mold and a vibrator mounted within the hopper and extending into the mold.

Turning now to FIG. 1, the concrete extruding apparatus of the present invention includes a vehicle 2 having a pair of front steering wheels 4, two pair of rear wheels 6, an engine 8, and a seat 10. Various hydraulic lines 11, 13 provide power from engine 8 for movement and control of vehicle 2. A hopper 12 is mounted centrally to vehicle 2. Hopper 12 has an inclined front or leading lower face 14 and, as shown best in FIG. 2, has an open bottom 16. An open bottom mold 18 extends rearwardly, in the direction of arrow 20, from the circumference of open bottom 16.

Figure 3:
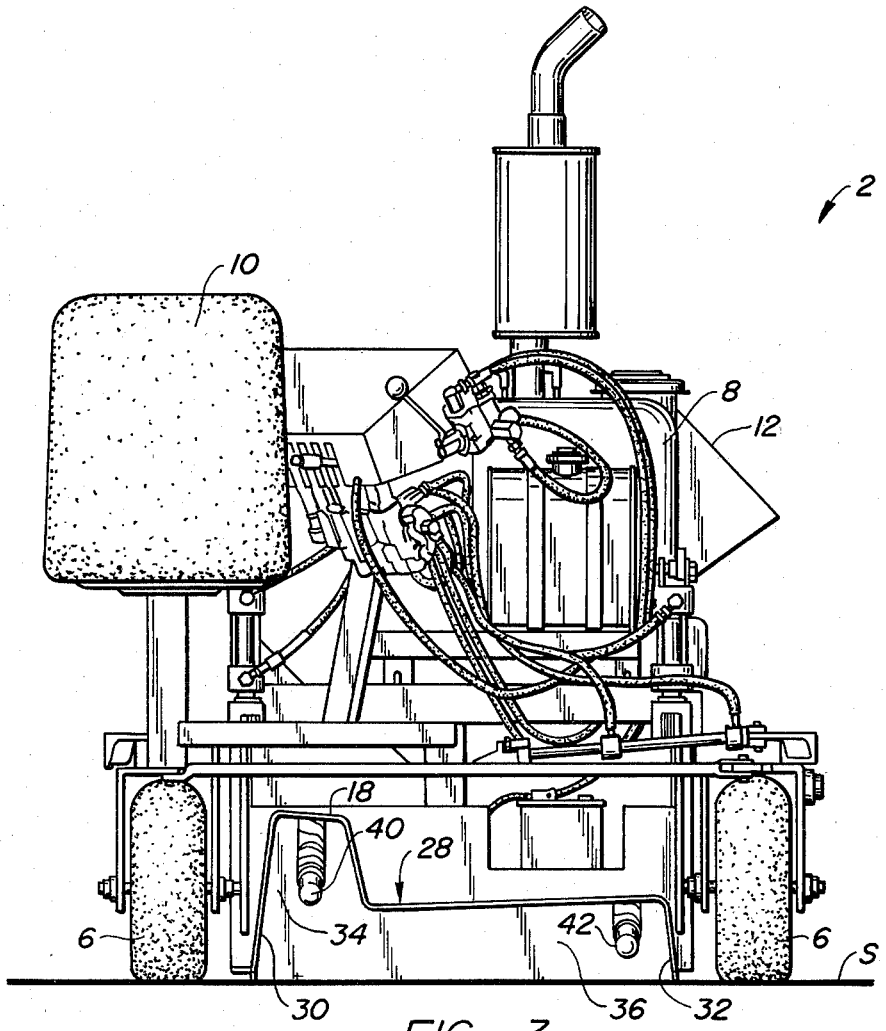
FIG. 3 is a rear end view of the apparatus of FIG. 1 showing the cross-sectional shape of the mold.

Mold 18 has a rearwardly and downwardly sloping leading portion 22 defining the throat 23 of mold 18. The balance of mold 18 to the rear of a point 24 is termed exit portion 26. Mold 18, as seen best in FIG. 3, includes a dual level top 28 and a pair of sides 30, 32. Top 28 and sides 30, 32 define a curb portion 34 and a gutter portion 36. The portion of top 28 coextensive with exit portion 26 of the mold has a slight rearward and upward taper so that the distance between top 28 and the surface S along which vehicle 2 moves is greater at the discharge end 38 of mold 18 compared to the distance at point 24. The negative taper reduces the drag by the cement within the mold on the vehicle and also reduces the tendency of the vehicle to ride up on the continuously extruded concrete. A taper of about 0.4 to 0.8 degree has proven effective. A greater taper often results in the concrete not filling the mold while a lesser taper increases the drag on the apparatus. However, these values may vary depending upon operating factors such as the condition of the concrete, the size of mold 18, the amount of concrete in hopper 12 and so forth.

A pair of vibrators 40, 42 are mounted within hopper 12 via isolation clamps 44 affixed to opposed side walls 46 of hopper 12. The isolation clamps reduce the amount of vibration transmitted from vibrators 40, 42 to mold 18 so that the concrete sets up within the mold sufficiently prior to exiting discharge end 38.

One immersion type vibrator which can be used is an angle head vibrator, made by Wyco Tool Co. of Chicago, Illinois, capable of being operated at up to 10,000 Hertz. Vibrators 40, 42 are driven by engine 8 through hydraulic lines 48, 50. The vibrators are mounted so that they are situated to the rear of leading face 14 at an angle of approximately 15° from the horizontal, so that they extend a short distance within throat 23 of the mold, and so that they overlie open bottom 16 of the hopper. The vibrators are mounted at an angle to the horizontal to increase the angle of attack of the vibrator with respect to direction of travel of the vehicle. The angular orientation of the vibrators is adjusted so that their distal ends 41, 43 are approximately vertically centered within the throat. By this arrangement the angled leading face 14 tends to cause the apparatus to move forward because of the force applied to it by the concrete above it in the hopper and also by the vibrational forces transmitted through the concrete. However, the vibrators may not perform the desired driving function as described below as efficiently if they are placed horizontally rather than at an angle to the horizontal. Further, because of the influence of the leading face of the hopper, the vibrators should be located directly to the rear of leading face 14. It is not required that the vibrators extend within the throat area although it has been found in the preferred embodiment that it is desirable to do so.

It is believed that the angled leading face 14, forming an exemplary angle of about 30° to a vertical, of hopper 12 helps to cause the apparatus to be driven forward for two reasons. First, the concrete contacting surface S below open bottom 16 acts as an anchor or barrier to any rearward movement of the apparatus. Therefore the vibrational movement of the concrete parallel to mold 18 can push the apparatus forward but not rearward. Second, the vibrators also cause the concrete to vibrate vertically as well as horizontally. Therefore the vibrating concrete alternatingly pushes downward on the slanted leading face 14 to urge the apparatus forward. The static pressure by the concrete within the hopper above leading force 14 also applies a forward force to the vehicle regardless of the forces caused by the vibrators.

The balance of the structure of the vehicle will not be described as it forms no part of this invention.

The operation of the apparatus of the present invention will now be discussed. The vehicle is typically used to lay a curb and gutter along the edge of a roadway path prior to building the roadway. The hopper is typically fed by a cement truck which moves along the roadway bed along with the vehicle. By adjusting the speed at which concrete is poured into the hopper from the truck, the hopper can be kept at a relatively constant level. The concrete within the hopper surrounds vibrators 40, 42 and will naturally flow partially into mold 18 and onto surface S. The operator activates vibrators 40, 42 adjusting the amount of hydraulic fluid to the vibrators so that the speed of vibration can be controlled. The movement of the vibrators both liquefies and compacts the plastic concrete mixture and causes it to flow into the mold more readily. Due to the placement and angular disposition of the vibrators and the slanted leading face 14 of the hopper, the entire vehicle, along with the hopper and attached mold, is caused to slowly move forward, that is in the direction opposite arrow 20. This forward movement is thought to be due primarily due to the location of the vibrators directly to the rear of leading face 14 of the hopper and the mounting of the vibrators at an angle to the horizontal. Also since top 28 angles upwardly between point 24 and discharge end 38 of mold 18, the drag on the vehicle is reduced. Therefore, the vibrational energy causes the vehicle to move forward. However, auxiliary driving power can be supplied to the vehicle, typically by hydraulic motors attached to one or more of the wheels. Further, in certain circumstances it may be necessary to retard the motion of the vehicle by applying the brakes of the vehicle in a regulated fashion.

Although the preferred embodiment of the invention has been shown and described, it will be apparent that modification and variation may be made without departing from the subject of the invention as defined in the following claims. For example, the mold can be produced in a variety of cross-sectional shapes and a greater or lesser number of vibrators can be used within the lower areas of the hopper.

What is claimed is:

1. Apparatus for extruding concrete in a desired cross-sectional shape onto a surface as the apparatus moves forward comprising:

an open bottom hopper for holding a quantity of concrete, said hopper having a downwardly and rearwardly directed lower leading face;

vehicle means for moveably supporting said hopper above the surface;

an open bottomed mold having entrance and discharge ends, said entrance end configured for attachment to an edge of the open bottom of said hopper, said mold supported immediately above the surface, said mold having said desired cross-sectional shape at a first point near said entrance end of said mold for extrusion of the concrete into said desired cross-sectional shape, a major portion of an upper surface of said mold rearward of said first point being inclined upwardly and rearwardly above a horizontal; and means for vibrating the concrete while passing from said hopper into said mold, said vibrating means located directly rearward of said leading face and including a vibrating member immersed within the concrete and vibrating in at least a first direction generally parallel to said forward direction so that the concrete flows from said hopper, past said leading face and said vibrating member, and is extruded through said mold, the vibration of the immersed vibrating member tending to propel said apparatus forward.

2. The extrusion apparatus of claim 1 wherein said leading face forms an angle of about 30° to a vertical.

3. The extrusion apparatus of claim 1 wherein said upper surface is inclined at a second angle of between about 0.4 and 0.8 degree.

4. The extrusion apparatus of claim 1 wherein said vibrating means at least partially overlies the open bottom of said hopper.

5. The extrusion apparatus of claim 1 wherein said moveable supporting means is steerable thereby enabling extrusion of the concrete along straight or arcuate paths.

6. In a curb forming apparatus of the type having an open bottom concrete hopper mounted to a vehicle, said vehicle having a front and a rear, vibration means immersed within the concrete, and an open bottom concrete mold extending rearwardly from the open bottom of said hopper, the improvement comprising:

said hopper having a downwardly and rearwardly angled lower leading face;

at least a portion of said vibration means mounted to overlay said open bottom and to be directly behind said leading face so that vibration from said vibrating means within said concrete tends to drive said vehicle in a forward direction; and said mold having a top surface a majority of which is angled upwardly from front to rear to reduce the drag on said apparatus.

7. The apparatus of claim 6 wherein said vibration means includes a vibrator mounted within said hopper at an angle to the horizontal.

8. The apparatus of claim 7 wherein a portion of said vibrator extends within said mold.

* * * * *